US011529719B2

(12) United States Patent
Chu et al.

(10) Patent No.: US 11,529,719 B2
(45) Date of Patent: Dec. 20, 2022

(54) BOLT CLAMPING FORCE TRANSDUCER FOR BOLT TIGHTENING OPERATION

(71) Applicant: CHINA PNEUMATIC CORPORATION, Taoyuan (TW)

(72) Inventors: Hsiu-Feng Chu, Taoyuan (TW); Yu-Wei Chu, Taoyuan (TW)

(73) Assignee: CHINA PNEUMATIC CORPORATION, Taoyuan (TW)

( * ) Notice: Subject to any disclaimer, the term of this patent is extended or adjusted under 35 U.S.C. 154(b) by 102 days.

(21) Appl. No.: 17/209,266

(22) Filed: Mar. 23, 2021

(65) Prior Publication Data

US 2022/0305630 A1 Sep. 29, 2022

(51) Int. Cl.
*B25B 23/14* (2006.01)

(52) U.S. Cl.
CPC ..... *B25B 23/14* (2013.01)

(58) Field of Classification Search
CPC ..... B25B 23/14
See application file for complete search history.

(56) References Cited

U.S. PATENT DOCUMENTS

2015/0122522 A1* 5/2015 Fujimoto ..... B25B 21/00 173/1
2015/0183099 A1* 7/2015 Hsieh ..... B60C 23/0496 73/862.21
2017/0057057 A1* 3/2017 Wilson, Jr. ..... B25B 17/02

* cited by examiner

*Primary Examiner* — Rick K Chang

(57) ABSTRACT

A bolt clamping force transducer for a bolt tightening operation is introduced to tighten a bolted joint by driving a torque rotating shaft in a clamping force transducer, such that a helical mechanism at one end of the torque rotating shaft generates an axial force for pressing a force sensing module and thus generates a strain value thereof. A socket is driven by the other end of the torque rotating shaft, thereby generating a clamping force under which the bolted joint of a specific specification is tightened. A parameter relation between the strain value and the clamping force is calibrated with a standard axial force gauge to facilitate calculation and control of the clamping force during the tightening process where the bolted joint fitted to any torque tool is sensed to control the precision of the clamping force being exerted on the bolted joint, thereby enhancing the quality thereof.

10 Claims, 12 Drawing Sheets cross-sectional view taken along line A-A

The thrust generated by a helical mechanism upon application of torque is calculated as follows:

$$Fa = 2 * \pi * \eta * T / (R \times 10^{-3})$$

| | | |
|---|---|---|
| Fa | : thrust Fsw or clamping force $F_{B\&W}$ | (N) |
| T | : torque | (N.m) |
| R | : thread lead | (mm) |
| $\eta$ | : efficiency | |

A: Calculation of thrust Fsw generated by the torque rotating shaft and exerted on a force sensing module when torque of 500 Nm is exerted on the clamping force transducer to tighten a M20, P-2.0 bolt and washer is as follows:

$$Fsw = 2*3.1416*0.95*500/(250*10^{-3}) = 11{,}983(N)$$

Thrust of 11,983 N is exerted on the force sensing module.

B: Calculation of clamping force $F_{B\&W}$ when torque of 500 Nm is exerted on the clamping force transducer to tighten a M20, P-2.0 bolt and washer is as follows:

$$F_{B\&W} = 2*3.1416*0.1*500/(2*10^{-3}) = 188{,}496(N)$$

Clamping force FB&W of 188,496 N is exerted on a to-fasten element (the M20, P-2.0 bolt and washer).

FIG.7C angled pulse wrench torque wrench static-force wrench pulse wrench impact wrench electric impact wrench

BOLT CLAMPING FORCE TRANSDUCER FOR BOLT TIGHTENING OPERATION

BACKGROUND OF THE INVENTION

1. Field of the Invention

The present disclosure relates to bolt clamping force transducers for bolt tightening operations, and in particular to a bolt clamping force transducer capable, in the course of tightening a bolted joint, of sensing a clamping force being exerted on the bolted joint and transmitting sensing data.

2. Description of the Related Art

Tightening a bolt with a torque wrench is a conventional technique widely used in an assembly operation of various products. In this regard, the application of torque is just a means to the end of tightening a bolt. Albeit a difficult one, the icing on the cake is to ensure that all bolts are tightened with conventional torque wrenches to the same extent, attaining the same degree of tightness. This is particularly true of pressurized containers, engine cylinders, and vacuum equipment. Carrying out high-precision tightening operations in a way to precisely control a clamping force applied to bolts is a concern to the industrial sector but remains an expectation unlikely to meet solely by controlling the tightening torque.

During a conventional bolt tightening process, only 10% of the torque converts to a clamping force, as governed by the "541" rule described below. Around 50% of the torque during the conventional bolt tightening process is required to overcome the friction between a bolt head or screw nut and an underlying contact surface. Around 40% of the torque during the conventional bolt tightening process is required to overcome the friction between threads. Only around 10% of the torque during the conventional bolt tightening process turns into a bolt clamping force. In addition, the magnitude of the residual clamping force depends on various factors related to a bolted joint, including the condition of a bolt and an object which the bolt is to be fastened in place (material hardness, processing precision, surface roughness, oil smear, rust and damage) and washer hardness, etc. As a result, it is difficult to control a pre-tightening force being applied to a bolt. Although equations and parameters pertaining to the calculation of torque and clamping forces are disclosed in engineering handbooks popular with academics and engineers, the equations and parameters remain unproved. The industrial sector is currently unable to come up with a low-cost, effective solution to analyzing the torque applied to a bolted joint and assessing the magnitude of the residual clamping force being exerted on the bolted joint, let along controlling the clamping force effectively. Therefore, quality risks and uncertainties abound insidiously in high-precision assembly operations carried out in a way to achieve uniform clamping forces.

Various conventional torque tools, such as torque controllers, digital torque wrenches, click torque wrenches, and electric servo controls, are in wide use to control the tightening torque. Conventional torque controlling methods involve applying torque of the same degree of magnitude to bolts of the same specification; however, the condition of the threads of the bolts is variable because of oil smears, rust, and damage, let alone the hardness of washers. Although the conventional torque controlling methods are touted as being able to attain a torque control accuracy tolerance of 5% or less, experiments show a maximum 50% tolerance of the residual clamping forces on the bolted joint.

Among conventional means of controlling a bolt tightening force, the most precise one is a bolt tension meter using ultrasonic sensing technology. However, it's manufacturing and installation cost is too high to be popular. Furthermore, a strain sensing component adhered to an appropriate point at the axis of a sensing bolt capable of sensing a bolt clamping force to detect its clamping force is pricey, and the sensing bolt can only be tightened with an open-end wrench to the detriment of ease of use and efficiency. Furthermore, a bolt transducer, a center-hole type compression load cell, and a piezoelectric sensing ring can each be used to detect and control a bolt tightening force but incur high manufacturing cost and lack ease of use.

BRIEF SUMMARY OF THE INVENTION

A clamping force transducer for a bolt tightening operation is provided and applied to various torque tools to not only instantly detect the magnitude of a clamping force generated by the applied torque and exerted on a bolted joint but also send data pertaining to the magnitude of the clamping force continuously, in a wired or wireless manner, to a control device or display device, display thereon the data, and record or upload the data, so as to get in line with the trend of industrial development of industry 4.0. The clamping force transducer of the present disclosure effectively enhances tightening precision, incurs low usage cost, demonstrates ease of use, and thus greatly increases effective industrial use.

To achieve at least the above objective, the present disclosure provides a device capable directly sensing a clamping force being exerted on a bolted joint in the course of the tightening of the bolted joint, as exemplified by a clamping force transducer attachable to a conventional manually-operated, pneumatic or electric torque wrench or screwdriver. According to the present disclosure, the clamping force transducer for use in a bolt tightening operation enables a torque tool to function as a clamping force wrench or clamping force screwdriver capable of directly controlling a clamping force. During a tightening process, the clamping force transducer instantly detects a clamping force being exerted on a bolted joint. The abovementioned is not only a great change and breakthrough in bolted joint fastening technology but also surpasses the conventional controlling tightening torque technology in tightening a bolted joint precisely to controllably attain a desirable clamping force exerted on the bolted joint, dispensing with expensive, inconvenient ultrasonic and axial force detection technology. According to the present disclosure, the clamping force transducer for use in a bolt tightening operation upgrades the bolted joint tightening technology to the greatest possible extent to thereby directly control the clamping force exerted on the bolted joint rather than exercise conventional torque control, thereby offering the industrial sector the best solution to bolted joint fastening.

The present disclosure provides a bolt clamping force transducer for a bolt tightening operation, comprising: a transducer body having an end being a torque tool's engaging portion to match the torque tool's force-generating end in dimensions and having another end having a threaded hole with a helical guiding groove, wherein a bottom of the threaded hole receives a force sensing module and meshes with helical guiding groove of the torque rotating shaft; the force sensing module comprising a sensing ring body and a force sensing component, wherein an annular recess is disposed at an edge of the sensing ring body, whereas the force sensing component is adhered to the bottom of the annular recess to sense the strain value of the sensing ring body axially loaded and electrically connected to a signal processing module; a dustproof plug disposed between the force sensing module and the torque rotating shaft and having a seal ring for preventing intrusion of foreign bodies into the force sensing module; a torque rotating shaft, wherein a plurality of helical guiding grooves are disposed at an end of the torque rotating shaft and correspond in position to the helical guiding groove in the threaded hole of transducer body, wherein a driving head is disposed at another end of the torque rotating shaft and matches a force-applying end of a socket in dimensions to tighten a bolted joint of a specific specification; a plurality of steel balls disposed between the helical guiding grooves of the transducer body and the helical guiding groove of the torque rotating shaft to lower rotational friction; a signal processing module disposed inside or outside the transducer body and having a signal amplifier, microprocessor, power circuit unit, signal transmission unit, input/output module, gyroscope, memory unit, transmission antenna and alert unit, the signal amplifier amplifying a sensed strain signal from the force sensing module to the signal processing module via a cable, allowing the amplified sensed strain signal to be computed by the microprocessor according to a pre-calibration parameter to obtain a clamping force value, the power circuit unit converting external power to power required by a power module, the signal transmission unit being wireless RF, Bluetooth, WiFi or ZigBee or being wired RS232, RS485 or UART to transmit signals to a control device or display device, the input/output module being a USB conducive to battery recharging and firmware update; the gyroscope detecting rotational angular displacement of the bolt clamping force transducer, the memory unit storing a parameter relation obtained by calibrating the bolted joint to be fastened in place and the strain value of the force sensing module with a standard axial force gauge, the alert unit being a buzzer or LED indicator indicative of signal strength, power state or usage state; the power module being a rechargeable battery and being electrically connected to the signal processing module; a holder fixed to the transducer body, wherein a protecting member encloses the signal processing module and the power module; the protecting member made of a material not blocking wireless signal transmission and adapted to protect the signal processing module and the power module; a cable electrically connected to the signal processing module and the force sensing component of the force sensing module; and a retaining ring for supporting the torque rotating shaft to allow the torque rotating shaft to slide within the threaded hole of the transducer body without detachment.

Therefore, when torque is applied to the clamping force transducer of the present disclosure, it drives the torque rotating shaft inside the clamping force transducer, such that the helical guiding groove at one end of the torque rotating shaft rotates and advances along the helical guiding groove in the threaded hole of the transducer body to thereby generate an axial force for pressing a force sensing module disposed at the bottom of the threaded hole and thus generating a strain value thereof. A socket is driven by the other end of the torque rotating shaft, thereby generating a clamping force under which the bolted joint of a specific specification is tightened. A parameter relation between the strain value and the clamping force is calibrated with a standard axial force gauge to facilitate the calculation and control of the clamping force during the tightening process. The specific specification of the bolted joint is about the dimensions, thread pitch, and surface condition (for example, processing dimension precision, surface roughness or degree of lubrication) of the bolt to be tightened and the hardness of a washer for use with the bolt. Therefore, given the parameter relation, the user matches the clamping force transducer with the control device or display device and then enters data about the bolted joint's specification (such as bolt grade, thread pitch and bore), hardness of a washer for use with the bolt, and desired target clamping force. After that, the user applies torque to drive the clamping force transducer of the present disclosure. During the tightening process, the signal processing module performs computation on the received parameter relation obtained by the calibration of the strain value of the force sensing module and the bolted joint to figure out the clamping force value and send it, in a wired or wireless manner, to the control device or display device. After the target clamping force has been attained, the control device instantly disconnects the power source of the torque tool or the display device uses a buzz or indicator to alert the user to stop applying the torque, detecting and controlling the clamping force of the bolted joint.

BRIEF DESCRIPTION OF THE DRAWINGS

FIG. 7C is a schematic view of calculation of a thrust and a clamping force of the bolt clamping force transducer of the present disclosure.

DETAILED DESCRIPTION OF THE INVENTION

Figure 1:
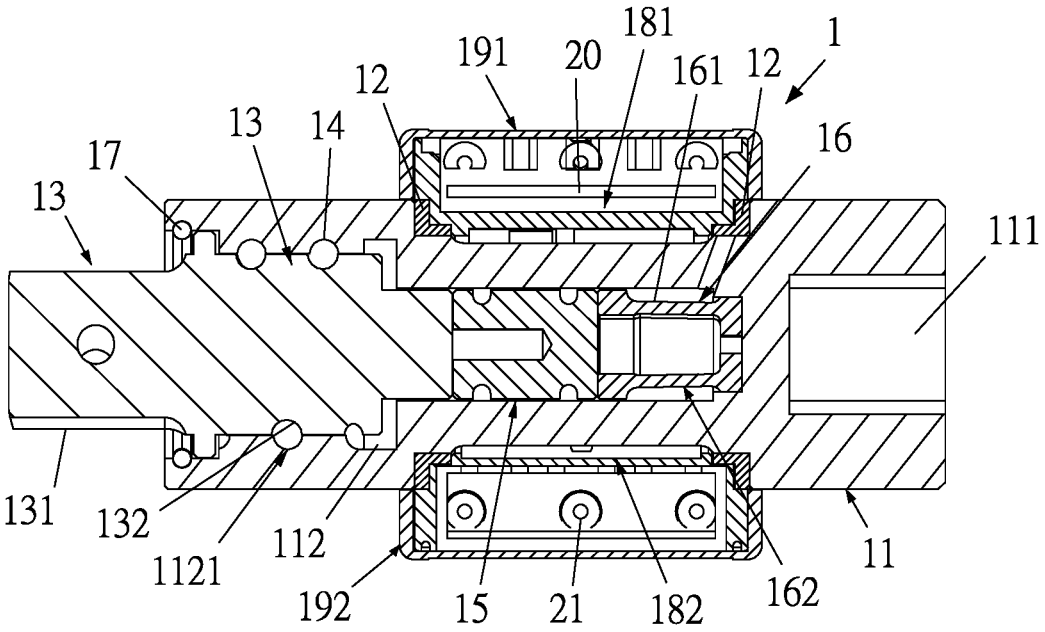
FIG. 1 is a cross-sectional view of a bolt clamping force transducer of the present disclosure.
Figure 2:
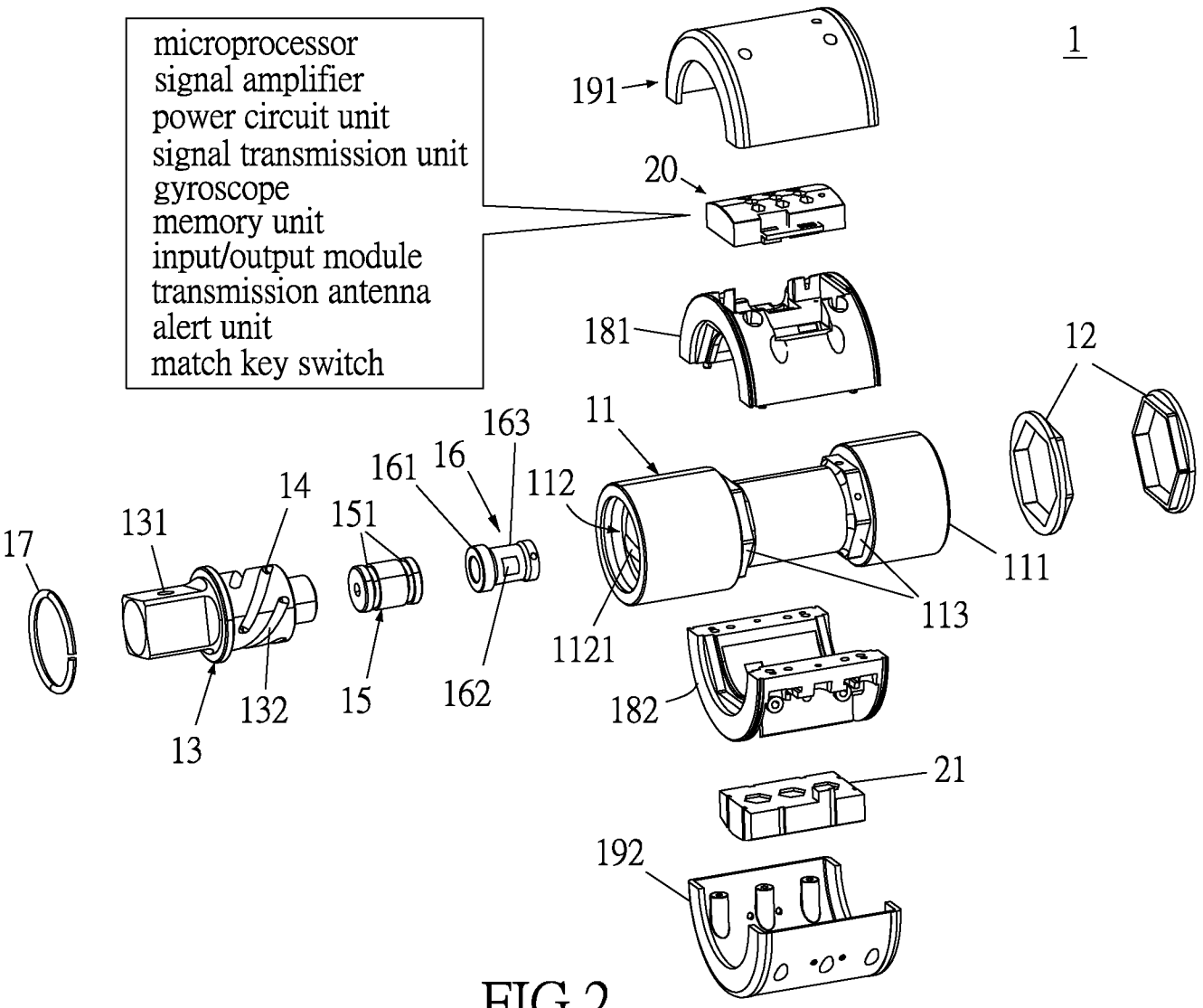
FIG. 2 is an exploded view of the bolt clamping force transducer of the present disclosure.
Figure 3:
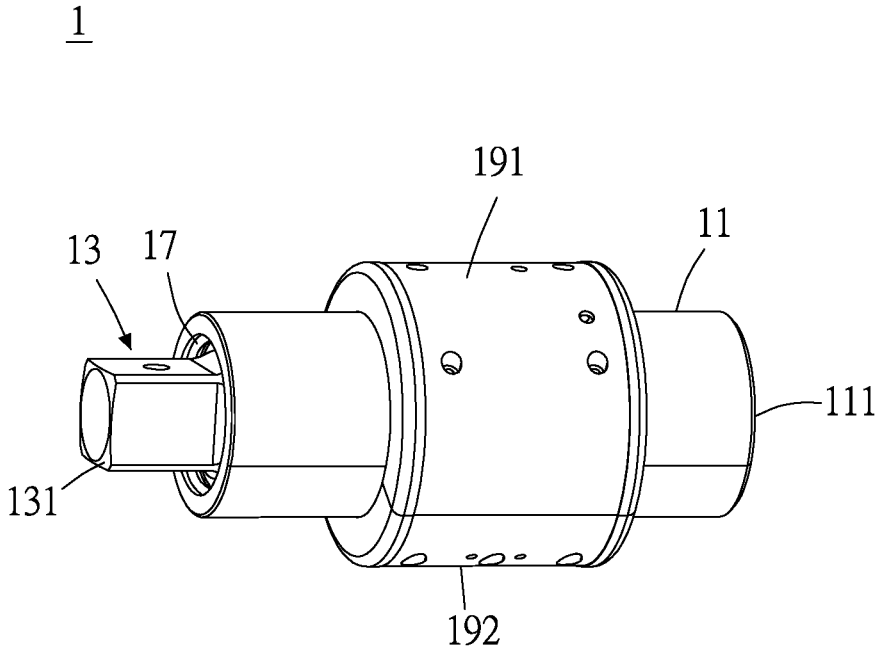
FIG. 3 is a perspective view of the bolt clamping force transducer of the present disclosure.

To facilitate understanding of the object, characteristics and effects of this present disclosure, embodiments together with the attached drawings for the detailed description of the present disclosure are provided.

Referring to FIG. 1 through FIG. 3, FIG. 6A and FIG. 6B, FIG. 7A through FIG. 7C and FIG. 8A and FIG. 8B, a clamping force transducer 1 of the present disclosure comprises a transducer body 11, force sensing module 16, dustproof plug 15, torque rotating shaft 13, steel balls 14, signal processing module 20, power module 21, buffer washers 12, holders 181, 182, protecting members 191, 192 and retaining ring 17. A torque tool engaging portion 111 is disposed at one end of the transducer body 11 and matches a torque tool's force-generating end in dimensions. The other end of the transducer body 11 has a threaded hole 112 with a helical guiding groove 1121 which meshes with a helical guiding groove 132 of the torque rotating shaft 13. The force sensing module 16 is disposed at the bottom of the threaded hole 112 of the transducer body 11. The force sensing module 16 has a sensing ring body 161 and force sensing component 162. The edge of the sensing ring body 161 has an annular recess 163. The force sensing component 162 is disposed at the bottom of the annular recess 163 and adapted to measure the strain value caused to the sensing ring body 161 under an axial force and generate a strain sensing signal. The force sensing component 162 and the signal processing module 20 are electrically connected. The sensing ring body 161 is mechanically fixed in place and thus prevented from rotating or detaching. Furthermore, the force sensing module 16 is any sensing component capable of sensing axial forces, such as a strain gauge or piezoelectric component. The dustproof plug 15 is disposed between the force sensing module 16 and the torque rotating shaft 13 and has a seal ring 151 whereby intrusion of foreign bodies into the force sensing module 16 is precluded. One end of the torque rotating shaft 13 has the helical guiding groove 132 which extends axially. The plurality of steel balls 14 are disposed between the helical guiding groove 132 of the torque rotating shaft 13 and the helical guiding groove 1121 in the transducer body 11; hence, when rotated, the torque rotating shaft 13 slides axially along the helical guiding groove 1121 in the threaded hole 112 of the transducer body 11, thereby effectively lowering the rotational friction. The resultant axial thrust is exerted on the end surface of the dustproof plug 15 and the end surface of the force sensing module 16. A force-generating head 131 is disposed at the other end of the torque rotating shaft 13 and matches a force-applying end of a socket 10 (shown in FIG. 8B) in dimensions. After the torque rotating shaft 13 and the transducer body 11 have been put together, the retaining ring 17 is fixed inside an annular recess at the outlet end of the threaded hole 112 of the transducer body 11; hence, the torque rotating shaft 13 slides within the threaded hole 112 of the transducer body 11 and thus is unlikely to detach. The holders 181, 182 operate in conjunction with the buffer washers 12 and are fixed to a buffer washer seat 113 of the transducer body 11 to receive the signal processing module 20 and the power module 21. The signal processing module 20 has a microprocessor signal amplifier, match key switch, power circuit unit, signal transmission unit, gyroscope, memory unit, input/output module, transmission antenna and alert unit and is electrically connected to the force sensing component 162. Sensed strain signals are sent by the force sensing component 162 and then received and amplified by a signal amplifier of the signal processing module 20 in order to convert to digital signals. After that, the digital signals are computed by the microprocessor according to a pre-calibration parameter to obtain a clamping force value and sent to a control device or display device via the input/output module and the transmission antenna. The signal processing module 20 is enclosed by a resilient material and disposed on the holder 181. The power circuit unit converts external power to power required by the power module 21. The gyroscope detects the rotational angular displacement of the transducer body 11. The memory unit stores a clamping force parameter. The clamping force parameter is obtained by calibrating the strain value of the force sensing module 16 and a bolted joint 8 with a standard axial force gauge 9 (shown in FIG. 8). Furthermore, the calibration parameters are stored in the memory unit of a control device or display device to enable a user to perform booting and then enter data pertaining to the specification of the bolted joint to obtain the corresponding parameters. Whatever difference between a tested datum and another one may arise because of variations in the specification of the bolted joints and washers but are correctable by a program. The power module 21 is a rechargeable battery enclosed by a resilient material, disposed at the holder 182 and electrically connected to the signal processing module 20. The protecting members 191, 192 are made of a material which does not block wireless signal transmission. The signal processing module 20 and the power module 21 are disposed at the holder 182 and thus protected. The signal transmission unit is a wireless communication module, such as RF, Bluetooth, WiFi or ZigBee, or is wired RS232, RS485 or UART. The input/output module is a USB for use in battery recharge and firmware update. The alert unit is a buzzer or LED indicator indicative of signal strength, power state, and usage state. The power module 21 is electrically connected to the signal processing module 20 and the force sensing component 162 of the force sensing module 16.

Before using the clamping force transducer 1, a user has to calibrate the clamping force transducer 1 and the bolted joint 8 fitted to the standard axial force gauge 9 in order to create a parameter relation between the strain value of the force sensing module 16 and a clamping force exerted on the bolted joint of a specific specification. Furthermore, there can be a linear relation between the clamping force and the strain value of the force sensing module 16 to enable the clamping force to be more precisely and easily controlled. If in the absence of a standard axial force gauge, the clamping force value displayed can be used as a reference target clamping force value of any subsequent bolted joint of the same specification in order to calibrate the bolted joint or fasten it in place with a conventional target torque but can still controllably maintain a uniform clamping force.

To perform a tightening operation with the clamping force transducer 1 of the present disclosure, the user matches the clamping force transducer 1 with the control device or display device, then enters data about the specification of the bolted joint 8, target clamping force and control accuracy, and uses the torque tool to apply torque to the clamping force transducer 1 in order to tighten the bolted joint 8. During the tightening process, the helical mechanism formed by and between the helical guiding groove 132 at one end of the torque rotating shaft 13 and the helical guiding groove 1121 in the threaded hole 112 of the transducer body 11 generates and exerts an axial thrust on the dustproof plug 15 and thereby presses against the end surface of the force sensing module 16, thereby causing the force sensing module 16 to generate a strain value; meanwhile, the other end of the torque rotating shaft 13 tightens the bolted joint 8 and thus generates a clamping force. There is a specific parameter relation between the clamping force, the strain value generated by the force sensing module 16, and the tightened bolted joint 8. The signal processing module 20 continuously calculates the value of the clamping force being exerted on the bolted joint 8 according to the parameter relation obtained beforehand by calibrating the strain value of the force sensing module 16 and the clamping force exerted on the bolted joint 8 of a specific specification. When the target clamping force is attained, the control device of the torque tool disconnects the power source or the display device uses a buzz or indicator to alert the user to stop operating and determine whether the target clamping force is satisfactory. As soon as the applied torque disappears, owing to the rigid rebounding force of the dustproof plug 15 and the sensing ring body 161 as well as the large thread pitch and large lead angle of the threads of the torque rotating shaft 13, the rebounding resistance is minimized, and in consequence the torque rotating shaft 13 restores its initial state (i.e., the state prior to application of force), thereby zeroing the strain value of the force sensing module 16.

When the clamping force transducer 1 of the present disclosure uses a tightening tool driven pneumatically, electrically or hydraulically, the control mechanism of the tool slows down the tool tightening speed just before the target clamping force is attained and then gradually approaches the target clamping force value by intermittent impacting, so as to effectively enhance the control accuracy of the clamping force.

Figure 4A:
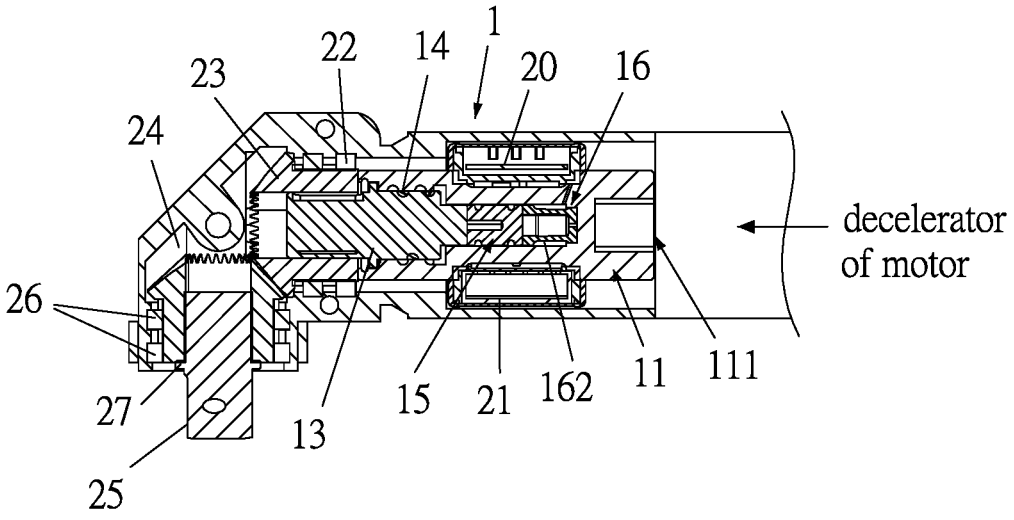
FIG. 4A is a first schematic view of operation of the bolt clamping force transducer of the present disclosure.
Figure 4B:
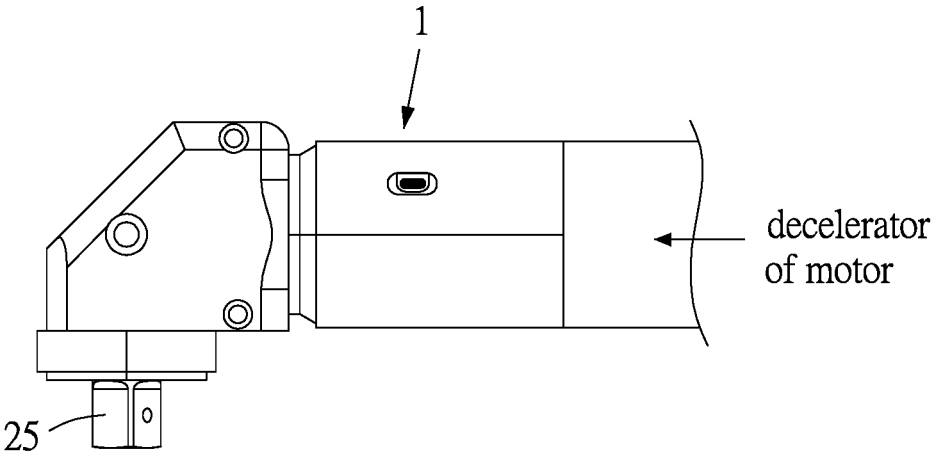
FIG. 4B is a second schematic view of operation of the bolt clamping force transducer of the present disclosure.
Figure 5:
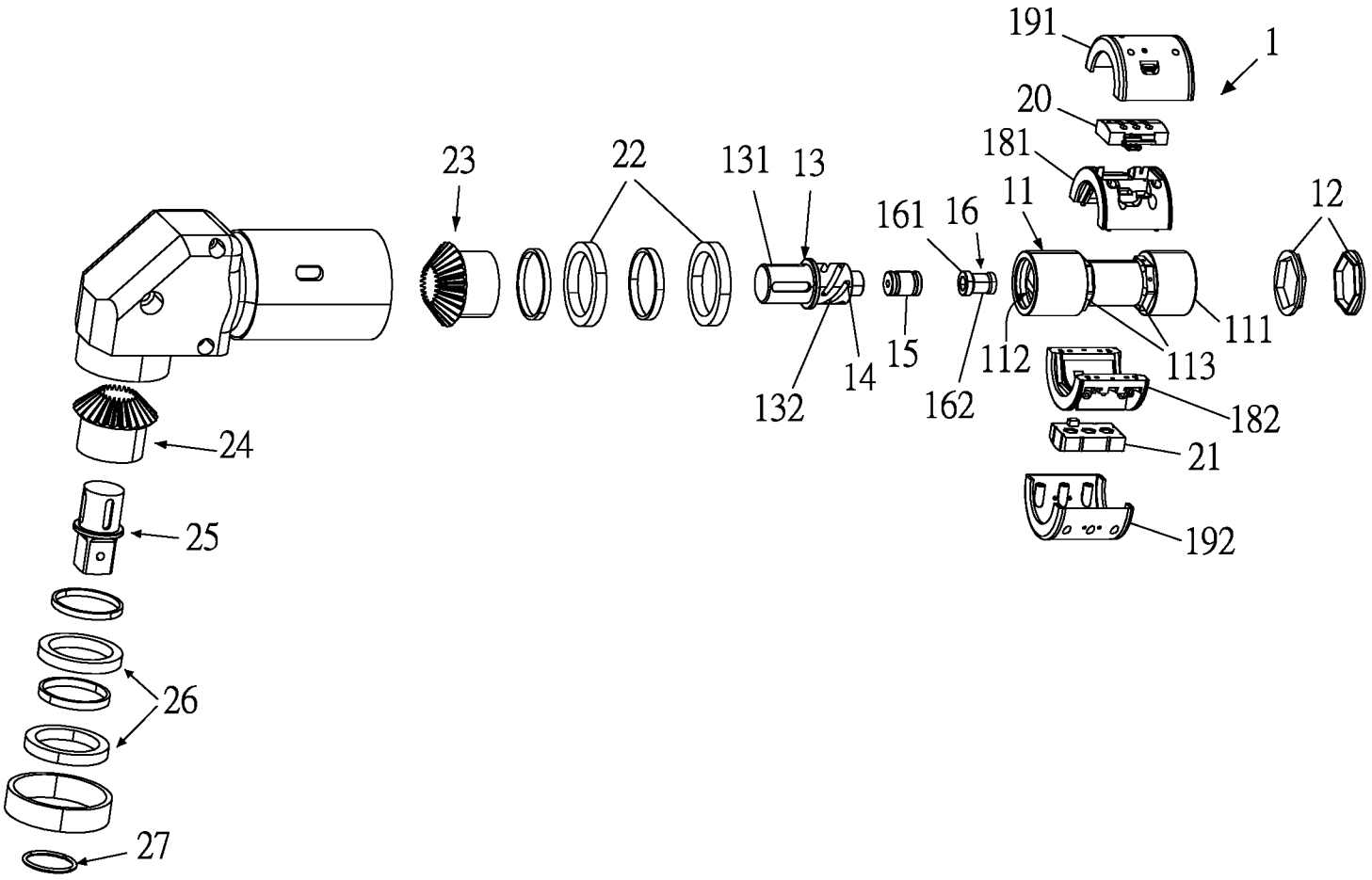
FIG. 5 is an exploded view based on FIG. 4B.

Referring to FIG. 4A and FIG. 4B, FIG. 5, FIG. 6A and FIG. 6B and FIG. 8A and FIG. 8B, the clamping force transducer 1 of the present disclosure is built-in in a torque tool which has steering gears 23, 24 and is rotatable thereby. The force-generating end of the motor speed reducing mechanism of the torque tool is inserted into the torque tool engaging portion 111 of the transducer body 11 of the clamping force transducer 1. When torque is applied to the clamping force transducer 1, the force-generating end 131 of the torque rotating shaft 13 of the clamping force transducer 1 penetrates a bearing 22 and thus is inserted into the steering gear 23 to drive the steering gear 24. A force-generating axle 25 of the steering gear 24 penetrates another bearing 26 and is fixed thereto with a retaining ring 27, such that the force-generating axle 25 is inserted into the socket 10 to tighten the bolted joint 8. The bolted joint 8 comprises a bolt 81, washer 82, nut 83 and to-fasten element 84. The operating principle depicted with FIG. 4A and FIG. 4B and FIG. 5 is the same as the operating principle depicted with FIG. 1 through FIG. 3, that is, drive the helical mechanisms (which differ in thread pitch) disposed at the two ends of the rotating shaft 13 while applying the torque to the clamping force transducer 1, as explained below. A strain value is generated under axial thrust $F_{SW}$ exerted on the force sensing module 16 by the helical guiding groove 132 along the helical guiding groove 1121 of the transducer body 11. Clamping force $F_{B\&W}$ is generated and exerted on the bolted joint 8 (shown in FIG. 6A and FIG. 6B) by the other end of the rotating shaft 13. A parameter relation between axial thrust $F_{SW}$ and clamping force $F_{B\&W}$ are calibrated beforehand with the standard axial force gauge 9 (shown in FIG. 8A and FIG. 8B). Then, the parameter relation is used to detect and control the clamping force of the bolted joint 8.

Figure 6B:
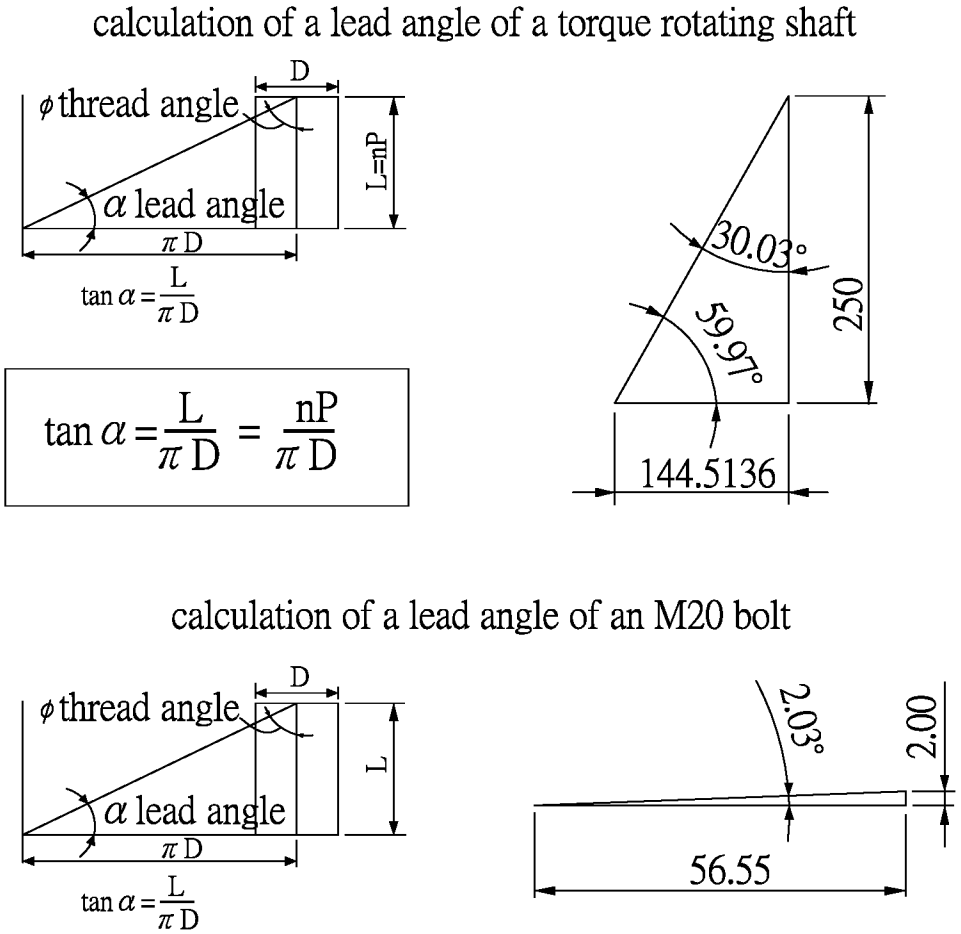
FIG. 6B is a second schematic view of the lead angle of the bolt clamping force transducer of the present disclosure.
Figure 6A:
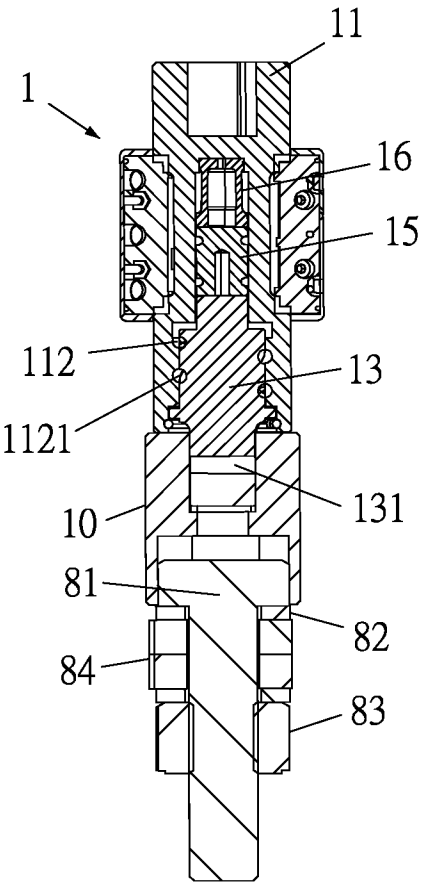
FIG. 6A is a first schematic view of a lead angle of the bolt clamping force transducer of the present disclosure.
Figure 7A:
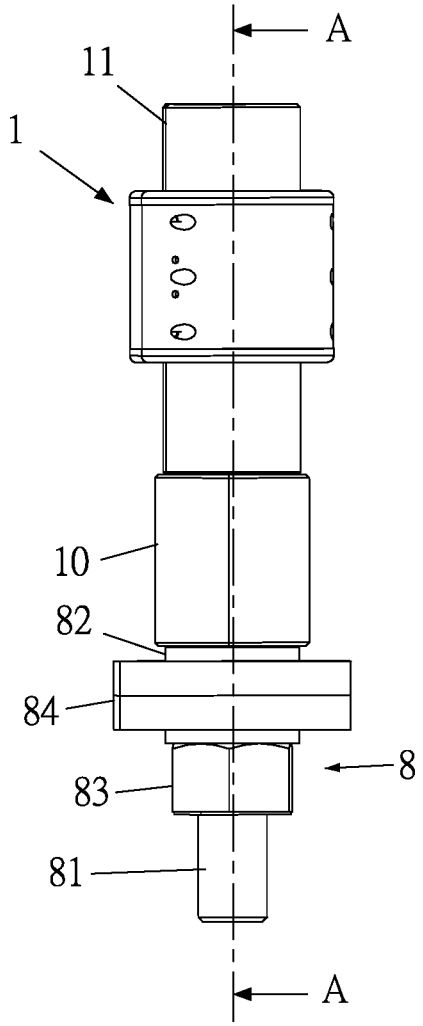
FIG. 7A is a lateral view of tightening a bolted joint with the bolt clamping force transducer of the present disclosure.
Figure 7B:
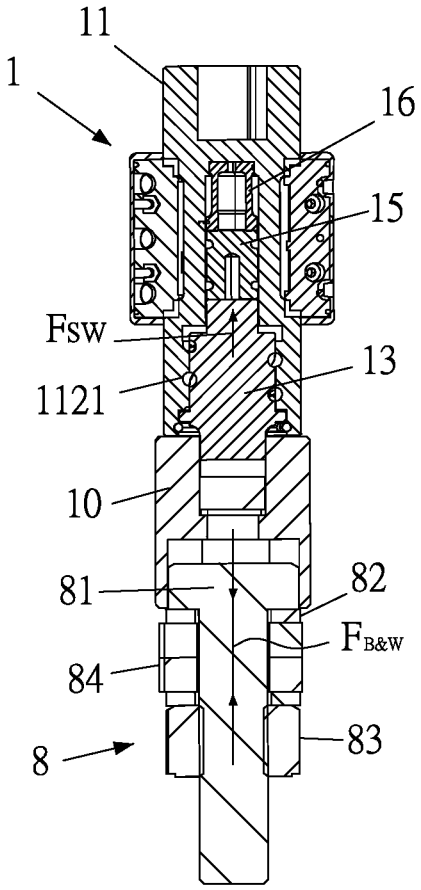
FIG. 7B is a cross-sectional view of tightening a bolted joint with the bolt clamping force transducer of the present disclosure.

Referring to FIG. 6A and FIG. 6B and FIG. 7A through FIG. 7C, the helical guiding groove 132 of the torque rotating shaft 13 and the helical guiding groove 1121 in the threaded hole 112 of the transducer body 11 have features, such as pitch diameter of 46 mm, pitch of 50 mm, number of threads of 5, and lead angle of 59.97°, whereas the bolted joint 8 fastened to the other end of the torque rotating shaft 13 have features, such as M20, pitch 2 mm, and single thread with lead angle of 2.03°. As shown in FIG. 7A through FIG. 7C, torque of 500 Nm is exerted on the clamping force transducer 1 to enable the torque rotating shaft 13 to tighten the bolted joint 8 of M20 so as to generate the clamping force $F_{B\&W}$ of 188,496 N, whereas, at the other end, the helical guiding groove 132 with number of threads of 5 exerts axial thrust $F_{SW}$ of 11,938N on the dustproof plug 15 and force sensing module 16 along the helical guiding groove 1121 in the threaded hole 112 of the transducer body 11. Furthermore, the strain generated by the dustproof plug 15 and sensing ring body 161 under the axial thrust $F_{SW}$ of 628.32 N falls within the range of the yield strength of the dustproof plug 15 and sensing ring body 161. Efficiency 11 for use in calculation of the thrust according to the torque is always an estimated value without affecting the conversion parameter obtained by calibrating the strain value of the force sensing module and the clamping force exerted on the bolted joint 8 and measured by the standard axial force gauge 9. Referring to FIG. 6A and FIG. 6B, the helical guiding groove 132 of the torque rotating shaft 13 has a lead angle of 59.97° which is greater than its friction angle. According to the present disclosure, for example, both the number of threads of the helical guiding groove 1121 of the transducer body 11 and the number of threads of the helical guiding groove 132 of the torque rotating shaft 13 are five to increase their pitch, increase their lead angle, and effectively reduce the axial force exerted on the force sensing module 16. The helical guiding groove is filled with the plurality of steel balls 14 and a lubricating grease, as is a ball screw, to minimize the frictional resistance of the helical mechanisms. Given friction coefficient f of 0.1, $f=0.1=\tan(\theta)$, resulting in $\theta=5.7°$, that is, a thread friction angle of 5.7°. The torque rotating shaft 13 has a lead angle much greater than friction angle 5.7°. Owing to the rigid rebounding capability of the dustproof plug 15 and force sensing module 16, disappearance of the torque enables the torque rotating shaft 13 to reverse and detach easily, thereby allowing the sensing value of the force sensing module 16 to zero.

Figure 8A:
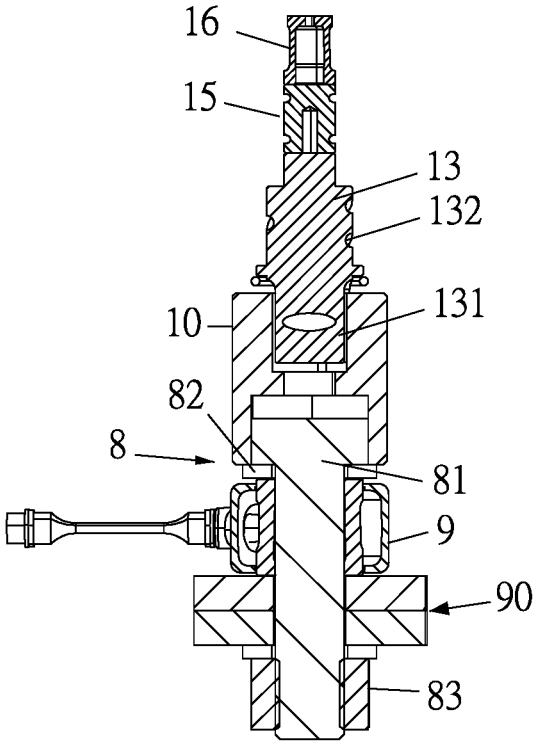
FIG. 8A is a partial schematic view of a parameter calibration structure of the bolt clamping force transducer of the present disclosure.
Figure 8B:
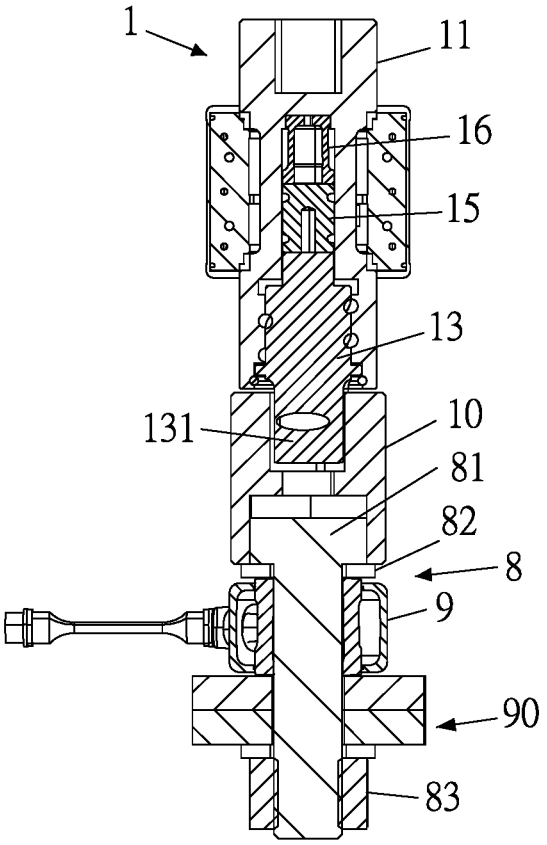
FIG. 8B is a full schematic view of the parameter calibration structure of the bolt clamping force transducer of the present disclosure.

Referring to FIG. 8A and FIG. 8B, the parameter calibration requires applying the torque to the clamping force transducer 1 with the torque tool, putting the socket 10 in place, passing the bolt 81 of a specific specification and the washer 82 (of the bolted joint 8) through the axial hole of the standard axial force gauge 9, mounting a test unit 90 in place, and fastening in place with the nut 83. To perform the calibration, the strain value generated by the force sensing module 16 under the axial thrust generated by the helical mechanisms is amplified with the signal processing module 20 and converted to a digital sensing signal. Then, the digital sensing signal is sent by the signal transmission unit to the control device or display device. The clamping force exerted on the tightened bolted joint 8 is measured by the standard axial force gauge 9 and instantly sent to the control device or display device to figure out the parameter relation between the clamping force and the strain value. Furthermore, parameter calibration must be performed anew, if the specification of the bolt 81, washer 82, or nut 83 of the bolted joint 8 changes.

Figure 9:
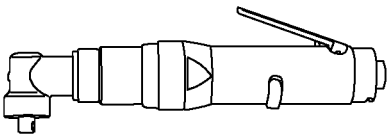
FIG. 9 is a schematic view of various torque tools applicable to the bolt clamping force transducer of the present disclosure.
Figure 9:
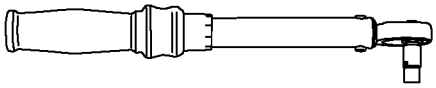
Figure 9:
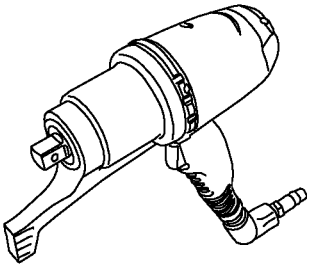
Figure 9:
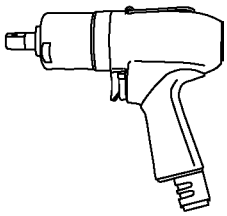
Figure 9:
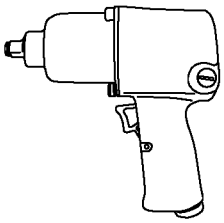
Figure 9:
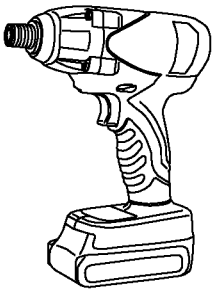

Referring to FIG. 9, the clamping force transducer 1 of the present disclosure is applicable to various conventional torque tools. The clamping force transducer 1 is attached to the force-generating end of the torque tool or is built-in in torque tool (shown in FIG. 4A, FIG. 4B and FIG. 5). The parameter calibration is performed on the bolted joint to be fastened in place. An appropriate control device or display device is used and connected. Then, the clamping force transducer 1 drives the socket to tighten the bolted joint to instantly measure the clamping force being exerted on the bolted joint, such that every torque tool can precisely control the clamping force.

Figure 10:
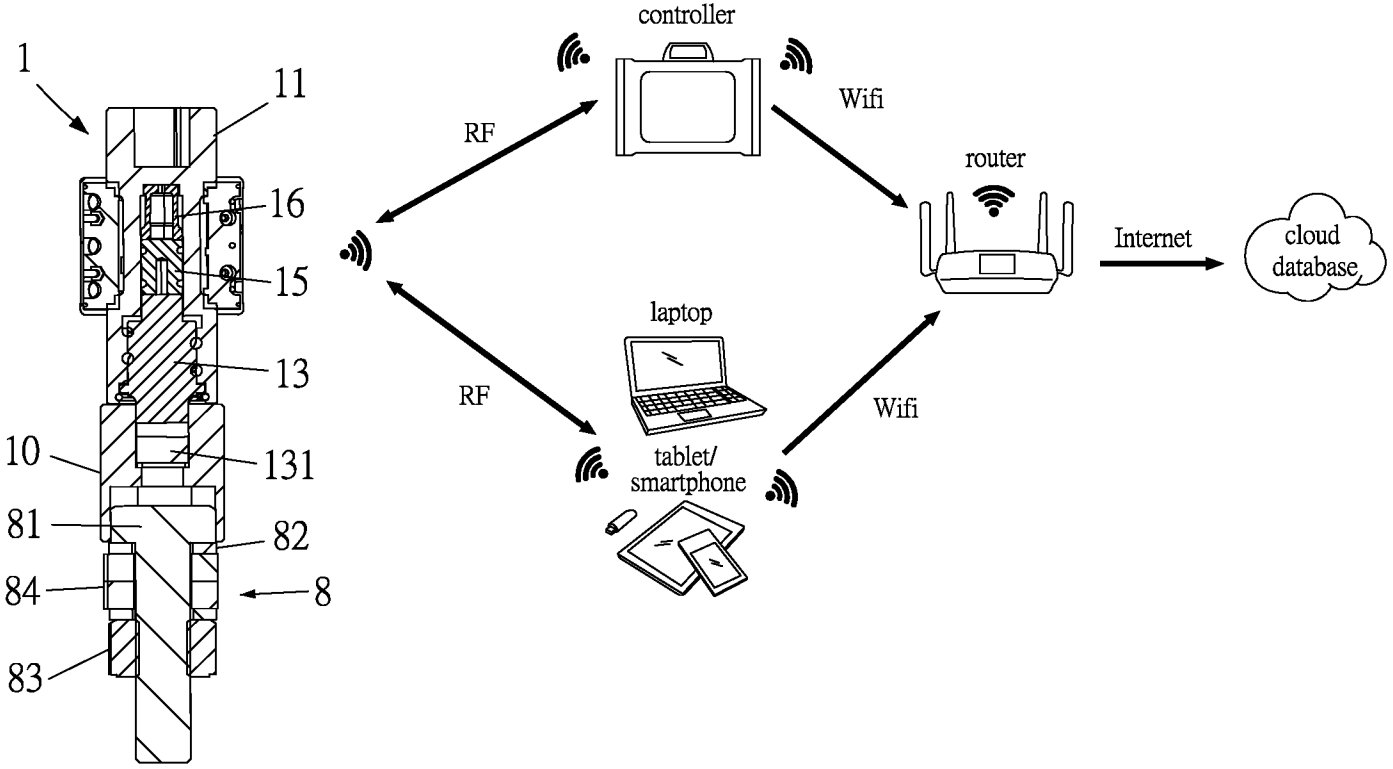
FIG. 10 is a schematic view of a system of operating the bolt clamping force transducer of the present disclosure.

Referring to FIG. 10, according to the present disclosure, the clamping force transducer 1 operates in conjunction with a control device or display device the manner described below. Data pertaining to the specification of a bolted joint and to a target clamping force are entered after the bolted joint has been tightened with the torque tool shown in FIG. 9 or with any torque tool. During the tightening process, the signal processing module continuously calculates the clamping force value according to the strain value and instantly sends the calculated clamping force value, in a wired or wireless manner, to the control device or display device of the torque tool. When the target clamping force value is attained, the signal processing module determines whether the target clamping force value is satisfactory, generates an alert buzz or message or disconnects the power source, and uploads related data to a peripheral server or cloud database as needed. Furthermore, when the strain value or clamping force value exceeds a predetermined value, the control device or display device of the torque tool can also give a warning and make a record.

While the present disclosure has been described by means of specific embodiments, numerous modifications and variations could be made thereto by those skilled in the art without departing from the scope and spirit of the present disclosure set forth in the claims.

What is claimed is:

1. A bolt clamping force transducer for a bolt tightening operation, comprising:

a transducer body having an end being a torque tool's engaging portion to match a force-generating end of the torque tool in dimensions and having another end having a threaded hole with a helical guiding groove, wherein a bottom of the threaded hole receives a force sensing module and meshes with a helical guiding groove of a torque rotating shaft;

the force sensing module comprising a sensing ring body and a force sensing component, wherein an annular recess is disposed at an edge of the sensing ring body, whereas the force sensing component is adhered to a bottom of the annular recess to sense a strain value of the sensing ring body axial and electrically connected to a signal processing module;

a dustproof plug disposed between the force sensing module and the torque rotating shaft and having a seal ring for preventing intrusion of foreign bodies into the force sensing module;

the torque rotating shaft, wherein a plurality of helical guiding grooves are disposed at an end of the torque rotating shaft and correspond in position to the helical guiding groove in the threaded hole of the transducer body, wherein a driving head is disposed at another end of the torque rotating shaft and matches a force-applying end of a socket in dimensions to tighten a bolted joint of a specific specification;

a plurality of steel balls disposed between the helical guiding groove of the transducer body and the helical guiding groove of the torque rotating shaft to lower rotational friction;

a signal processing module disposed inside or outside the transducer body and having a signal amplifier, microprocessor, power circuit unit, signal transmission unit, input/output module, gyroscope, memory unit, transmission antenna and alert unit, the signal amplifier amplifying a sensed strain signal sent from the force sensing module to the signal processing module via a cable, allowing the amplified sensed strain signal to be computed by the microprocessor according to a pre-calibration parameter to obtain a clamping force value, the power circuit unit converting external power to power required by a power module, the signal transmission unit being wireless RF, Bluetooth, WiFi or ZigBee or being wired RS232, RS485 or UART to transmit signals to a control device or display device, the input/output module being a USB conducive to battery recharging and firmware update;

the gyroscope detecting rotational angular displacement of the bolt clamping force transducer, the memory unit storing a parameter relation obtained by calibrating the bolted joint to be fastened in place and the strain value of the force sensing module with a standard axial force gauge, the alert unit being a buzzer or LED indicator indicative of signal strength, power state or usage state;

the power module being a rechargeable battery and being electrically connected to the signal processing module;

a holder fixed to the transducer body, wherein a protecting member encloses the signal processing module and the power module;

the protecting member made of a material not blocking wireless signal transmission and adapted to protect the signal processing module and the power module;

a cable electrically connected to the signal processing module and the force sensing component of the force sensing module; and a retaining ring for supporting the torque rotating shaft to allow the torque rotating shaft to slide within the threaded hole of the transducer body without detachment.

2. The bolt clamping force transducer of claim 1, wherein the helical guiding groove of the transducer body and the helical guiding groove of the torque rotating shaft each have a plurality of threads being in equal number and running in the same direction as the threads of the bolted joint to be tightened.

3. The bolt clamping force transducer of claim 1, wherein the helical guiding groove of the torque rotating shaft has a lead angle greater than a friction angle, and an axial thrust exerted by the torque rotating shaft on the dustproof plug and the sensing ring body falls within a range of yield strength of the torque rotating shaft, the dustproof plug and the sensing ring body, such that rigid rebounding capability thereof enables the torque rotating shaft to restore its position reversely along the helical guiding groove, thereby zeroing the sensing value of the force sensing module.

4. The bolt clamping force transducer of claim 1, wherein the signal processing module sends, in a wired or wireless manner, a clamping force value calculated according to the strain value to a control device or display device of the torque tool in order to control the clamping force of the bolted joint, wherein the control device or display device of the torque tool gives a warning and makes a record when the strain value or the clamping force value exceeds a predetermined value.

5. The bolt clamping force transducer of claim 1, wherein the force sensing module having a force sensing component to sense an axial force.

6. The bolt clamping force transducer of claim 1, wherein, while a torque is being applied to the torque rotating shaft, tightening the bolted joint of a specific specification with the upper one of two helical mechanisms undergoing concentric rotation and pressing against the force sensing module with the lower one take place simultaneously, wherein the signal processing module performs computation on clamping force conversion parameters created by calibration, so as to obtain a value of the clamping force being exerted on the bolted joint.

7. The bolt clamping force transducer of claim 6, wherein parameters for use by the microprocessor include the strain value of the force sensing module of the bolt clamping force transducer and the clamping force conversion parameter applicable to the bolted joint of a specific specification, wherein the strain value of the force sensing module of the bolt clamping force transducer and the clamping force conversion parameter applicable to the bolted joint of a specific specification are created when applying torque to the bolt clamping force transducer tightening the bolted joint of a specific specification and a standard axial force gauge and stored in the memory unit of the signal processing module or a corresponding control device or display device.

8. The bolt clamping force transducer of claim 7, wherein, if content of any item associated with the bolted joint changes, conversion parameters of the clamping force must be calibrated anew, wherein the content includes bolt specifications, washers or objects to be fastened in place.

9. The bolt clamping force transducer of claim 1, wherein the signal processing module sends, in a wired or wireless manner, the clamping force value calculated according to the strain value to the torque tool to control the device or display device and thereby control the clamping force exerted on the bolt, wherein the devices give a warning and make a record when the strain value or the clamping force value exceeds a predetermined value.

10. The bolt clamping force transducer of claim 1, wherein the bolt clamping force transducer is attached to or is built-in in the torque tool to function as a clamping force wrench or a clamping force screwdriver capable of detecting directly the clamping force being exerted on the bolted joint, wherein the torque tool is a conventional torque wrench or torque screwdriver.

* * * * *